US009060585B1

(12) United States Patent
Tran

(10) Patent No.: US 9,060,585 B1
(45) Date of Patent: Jun. 23, 2015

(54) NAIL STYLING DEVICE

(71) Applicant: Hai Minh Tran, Winchester, VA (US)

(72) Inventor: Hai Minh Tran, Winchester, VA (US)

( * ) Notice: Subject to any disclaimer, the term of this patent is extended or adjusted under 35 U.S.C. 154(b) by 0 days.

(21) Appl. No.: 14/148,403

(22) Filed: Jan. 6, 2014

(51) Int. Cl.
*A45D 31/00* (2006.01)

(52) U.S. Cl.
CPC ..... *A45D 31/00* (2013.01)

(58) Field of Classification Search
CPC combination set(s) only.
See application file for complete search history.

(56) References Cited

U.S. PATENT DOCUMENTS

| | | | | |
|---|---|---|---|---|
| 2,799,282 | A * | 7/1957 | Slack | 132/285 |
| 5,186,189 | A * | 2/1993 | Harris | 132/285 |
| 7,654,268 | B2 * | 2/2010 | Carpenter | 132/73 |
| 2011/0303237 | A1 * | 12/2011 | Lieu | 132/285 |

* cited by examiner

*Primary Examiner* — Rachel Steitz
(74) *Attorney, Agent, or Firm* — Whitham Curtis Christofferson & Cook, PC

(57) ABSTRACT

A nail styling device provides for applying a lacquer to a nail of a digit. A cuticle guard and a tip guard protect the cuticle and skin to the sides of and under the distal edge of the nail. A mold plate has a curved inner surface corresponding to a curvature of the nail and is attached to the cuticle guard by a joint. A base adjustably fixable to the cuticle guard allows for the device to be removably fixable to a distal portion of the digit. A method of using the device provides for first applying a lacquer to an inner surface of the mold plate and, with the device locked in place on the digit, rotation of the mold plate to bring the lacquer into contact with a top portion of the nail.

13 Claims, 5 Drawing Sheets

NAIL STYLING DEVICE

FIELD OF THE INVENTION

The invention generally relates to nail styling with lacquers and, more particularly, to applying lacquers such as acrylics and gels to nails without requiring direct application by a conventional brush.

BACKGROUND

Cosmetics represent a multi-billion dollar industry of which finger nail styling is a significant part. Nail salons provide professional services for both finger nail styling (e.g. manicures) and toe nail styling (e.g. pedicures), while a plethora of products and kits may be purchased for home use. Nail styling may include procedures such as filing and shaping of nails, painting of nails with any of a vast assortment of colors and complex patterns, application of small decals or imitation jewels, as well as addition of artificial nail gels, tips, or acrylics, including the well known French Manicure, as just one example.

Among the challenges of nail styling are the relatively small sizes of nails and a desire to avoid accidental contact of nail products, in particular gels and other lacquers, to the skin on either side of a nail (i.e. lateral nail folds), to the cuticle of the nail at the base of the nail plate, or to the skin under the distal end of the nail. The application of a lacquer is customarily performed directly on the nail plate (and/or over other styling products already on the nail plate), requiring a user to use his or her left hand for styling the right hand finger nails, and vice versa. This adds another challenge when an individual lacks dexterity with his or her non dominant hand. Complex nail styling techniques are often limited to professionals at nail salons, where procedures such as applying gels and acrylics involving considerable eye-hand coordination, finesse, experience, and technique. These procedures can be expensive at nail salons, but many nail styling enthusiasts cannot satisfactorily apply gels and acrylics on their own at home. There is therefore an ongoing demand for new tools and techniques which facilitate easier and more efficient application of gels and lacquers to a nail, allowing for improved and repeatable results by home users and professional nail stylists alike.

SUMMARY

Nail styling devices and methods are provided for applying a lacquer to a nail of a digit, such as a fingernail of a finger or a toenail of a toe. Generally, a nail styling device according to the invention includes a cuticle guard, a tip guard, a mold plate, and a base. A cuticle guard for protecting at least the skin at the base of a nail is configured to cover or shield a top surface of a distal portion of the digit and has a curved distal edge sized to fit a cuticle. A tip guard is generally moveable in a longitudinal direction relative the cuticle guard. The tip guard has at least a proximal edge slideable under the distal end of the nail for protecting the skin at/under the distal end of a nail. One or both of the cuticle guard and the tip guard are configured to cover or shield a lateral nail fold to either side of the nail. A mold plate has a curved inner surface corresponding to a curvature of a nail and is attached to the cuticle guard by a joint. A base is adjustably attachable to the cuticle guard such that the base and the cuticle guard are removably fixable to a distal portion of the finger or toe.

For applying a lacquer to a nail of a digit, lacquer may first be applied to an inner surface of a mold plate of a nail styling device. The device should be fitted on a distal portion of the digit such that cuticle, lateral nail folds, and quick (i.e. hyponychium, or skin below the distal end of the nail) of the digit are protected by the nail styling device and the inner surface of the mold plate is rotatably contactable with the top surface of the nail. The mold plate may simply be rotated about a pivot point provided by a joint at an end of the mold plate until the lacquer contacts the nail. One or more locks may be engaged to prevent accidental lifting of the mold plate once pivoted down over the nail. The lacquer may then be cured, such as with LED or UV light or by other means such as heat, to fix the lacquer to the nail. After curing, the nail styling device may be removed from the digit.

A nail styling device according to the invention may also be used to apply fake nails, including press-on nails and pre-made nails such as those sold in supermarkets and drugstores, to a user's natural nails. The mold plate is configured to hold the fake nail. An adhesive lacquer, if required, may be applied to the bottom surface of the fake nail instead of the inner surface of the mold plate. The nail styling device is then usable to position and apply the fake nail to the top surface of the nail.

DETAILED DESCRIPTION

Figure 1A:
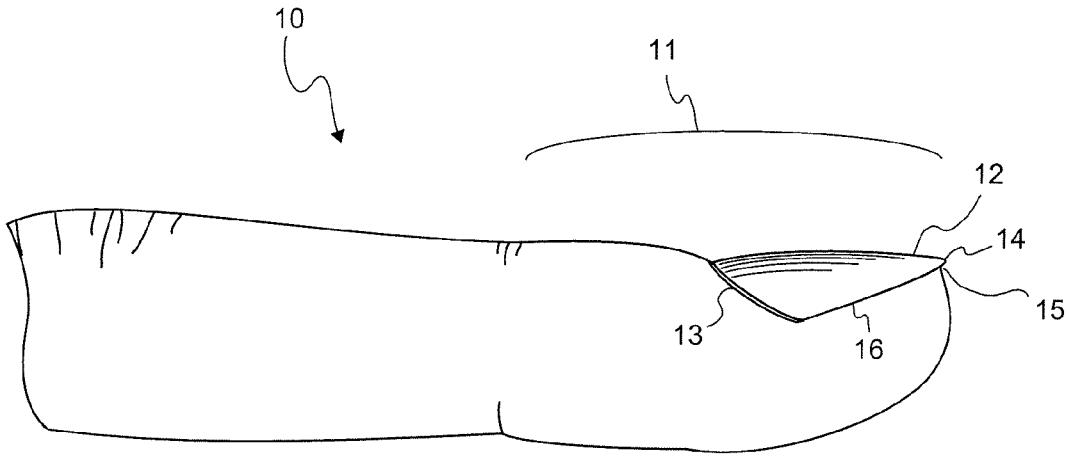
FIGS. 1A and 1B show a human finger and fingernail.
Figure 1B:
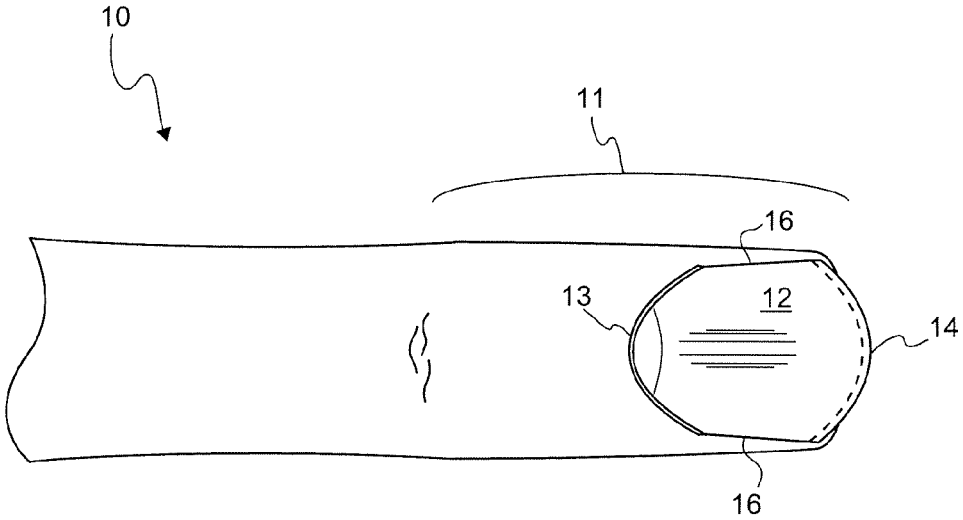
Figure 2A:
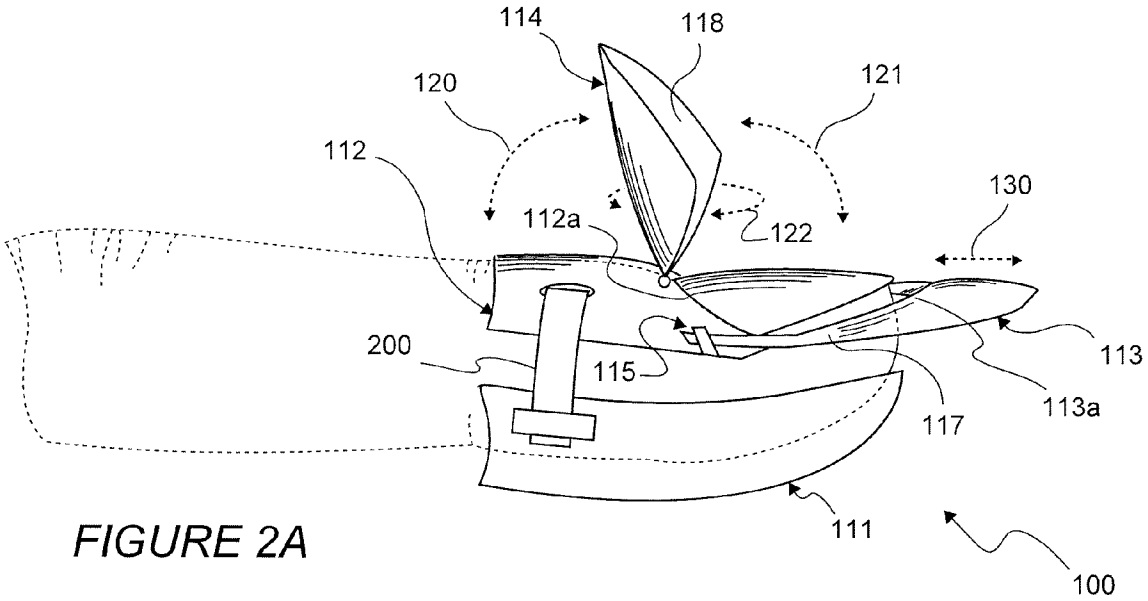
FIGS. 2A and 2B are a nail styling device for applying a lacquer to a nail of a digit.
Figure 2B:
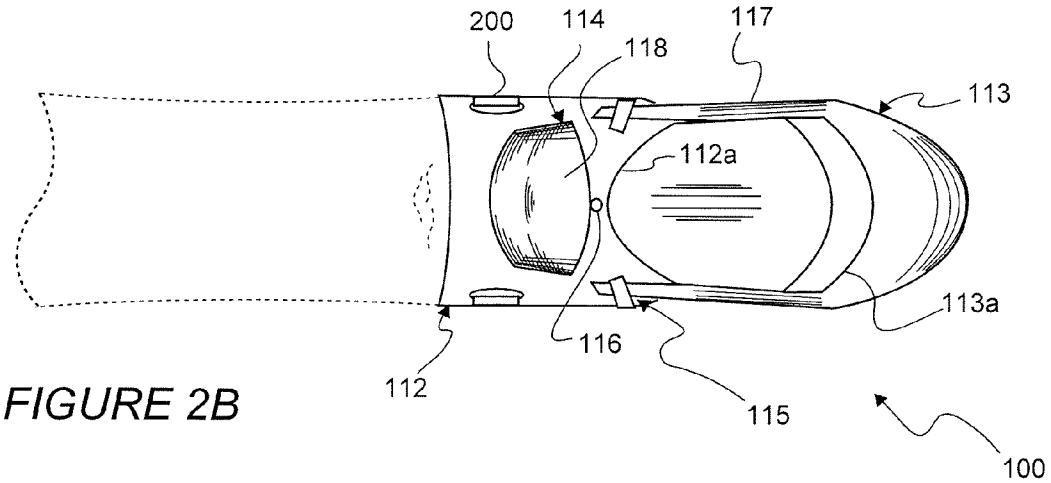
Figure 3A:
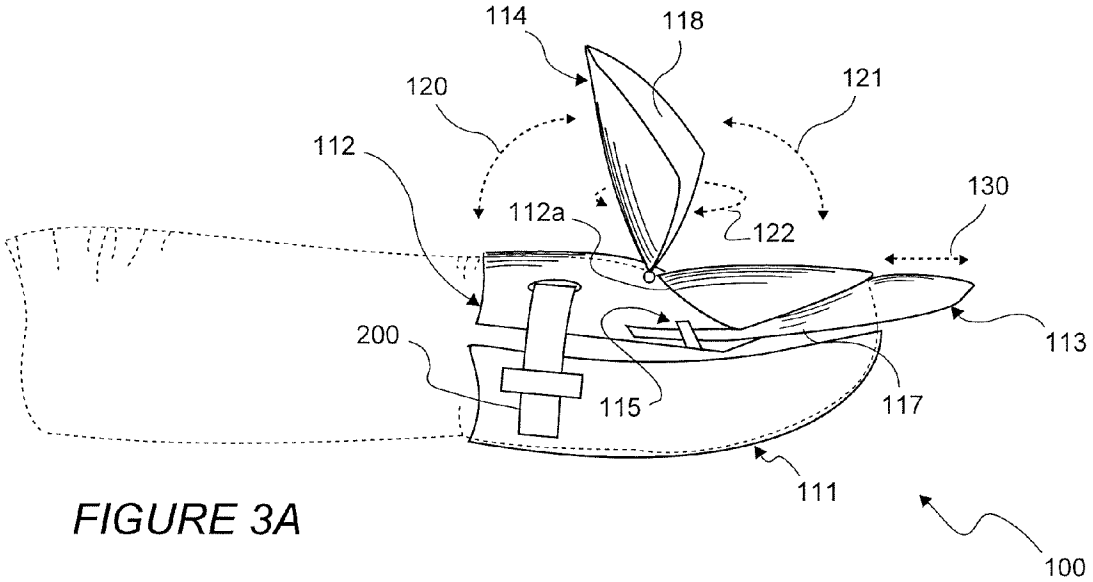
FIGS. 3A and 3B are a the nail styling device of FIGS. 2A and 2B with the device fitted and locked on a finger of a user.
Figure 3B:
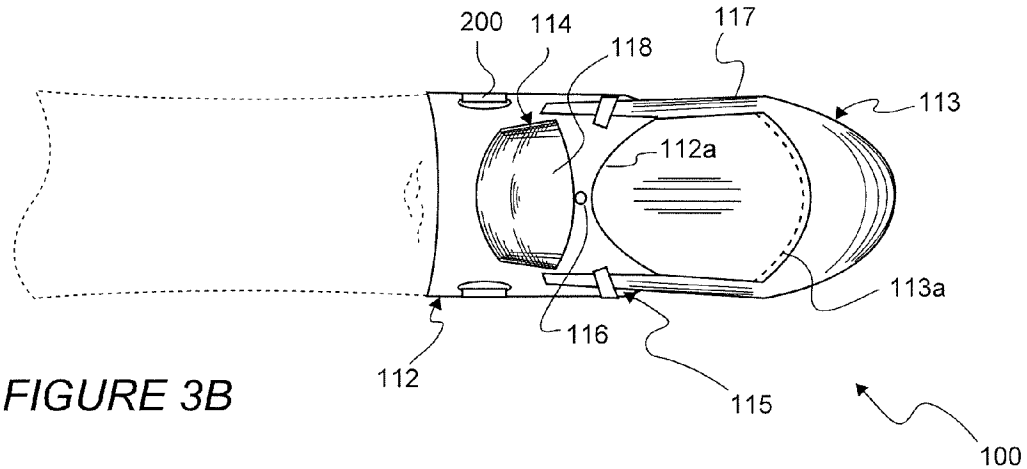

Referring now to the drawings and more particularly FIGS. 1A-1B, a finger 10 is shown and identified according to terms understood in the art and useful in describing the invention. Generally, the invention as taught herein is sized for use on a human finger or toe and may vary in scale in a manner corresponding with the variation in finger/toe size and fingernail/toenail size. It will be understood by those of skill in the art that sizing of invention features, including radii of curvature, arc lengths, lengths, widths, and height of, for example, entire device elements or edges of such elements, may be selected according to anatomical measures provided in medical literature according to size comparisons made herein. A finger 10 includes a distal portion comprising a distal phalanx 11 and a nail (plate) 12. A nail 12 is surrounded by skin/tissue. At a base of the nail 12 is an eponychium, or cuticle 13 which has a curved "smile" line. Opposite the cuticle is the nail's distal end 14, under which is the hyponychium, or quick 15 which also has a curved contour spanning a width of the nail. Running from the cuticle 13 to the distal end 14 of the nail are the left and right lateral nail folds 16.

Unless identified otherwise by context, the term "nail" and "nail plate" are used interchangeably herein, indicating the keratin-based structure of human fingers or toes to which nail styling products are traditionally applied. Furthermore, application of a lacquer to a nail or a top surface of a nail may indicate application of such lacquer directly to a top surface of such nail or to one or more products of which at least one is applied directly to a top surface of the nail. Thus it should be understood that, according to the invention, a lacquer may be applied to a surface of some base coat, lacquer, fake nail, nail extension (e.g. acrylic nail extension), or other nail styling product previously applied or being applied to the top surface of the nail. Lacquer, as used herein, generally includes but is not limited to gels, acrylics and, such as in the case of applying fake nails, adhesives. The invention is not limited to use with nails which are completely clean and free of other nail styling products.

Referring now to FIGS. 2A-2B and 3A-3B, an applicator 100 is a nail styling device for applying a lacquer to a nail of a digit, i.e. a fingernail of a finger of a hand or a toenail of a toe of a foot. Generally, an applicator 100 does not require a lacquer be applied directly to a surface of a nail by way of a brush. In the event that a brush may still be used, an applicator 100 provides the option to a user of always using his or her dominant hand for handling the brush regardless of the nail to which the lacquer is being applied. Although the applicator is suited for use with one or more nails of both fingers and toes, the exemplary embodiments discussed herein will generally refer to the nails of fingers for simplicity and conciseness.

An applicator 100 generally comprises at least one base 111, at least one cuticle guard 112, at least one tip guard 113, and at least one mold plate 114. Generally, a cuticle guard 112 and a tip guard 113 serve to reduce or eliminate the risk of lacquer contacting skin at the base of a nail (particularly the cuticle), skin to either side of a nail (i.e. lateral nail folds), and skin under a distal edge of the nail (e.g. the hyponychium or "quick"). Together the guards 112 and 113 cover or otherwise shield these tissues from exposure and contact to a lacquer while leaving exposed up to the entire top surface of the nail.

More particularly, cuticle guard 112 is configured to a cover or shield a top surface of a distal portion of the digit and has a distal edge having a curved "smile" line which substantially matches the contour of a cuticle. This edge protects the cuticle/eponychium at the base of the nail plate. Tip guard 113 provides protection of the skin under the distal end of the nail plate, including the hyponychium or "quick". The tip guard 113 is moveable in a longitudinal direction, such as shown by dashed arrow 130, relative to the cuticle guard such that a proximal edge of the tip guard is slideable under the distal end of the nail. When being used, the tip guard 113 may effectively be slid longitudinally to a maximum displacement from the cuticle guard 112 to facilitate installation of the two guards about the nail. With the cuticle guard substantially in place protecting the cuticle, the tip guard may be slid longitudinally towards the cuticle guard until a proximal edge of the tip guard slides comfortably under the distal edge of the nail. One or more tip guard connectors 115 are provided to regulate the relative positions of guards 112 and 113. Tip guard connector 115 may comprise, for example, a slot of cuticle guard 112 through which an extension 117 of tip guard 113 may be fitted/passed, such as is shown in the figures. Tip guard connector 115 may include locking features, such as a raised bump or tooth (not shown) on cuticle guard 112 which selectively engages with one of a plurality of concave dimples or slots (not shown) aligned in a row on a portion of tip guard 113 which overlaps with cuticle guard 112. The bump or tooth may lock into any one of the plurality of concave dimples or grooves. In an engaged configuration, the two guards 112 and 113 create a window in which a top portion of the nail (such as the entire top surface) fills the window while the edges of such window cover or shield skin at any edge of the nail. The proximal edge 113*a* of a tip guard 113 is preferably curved with a "smile" line which generally follows a contour of the quick under the distal end of the nail.

One or more of a cuticle guard 112 and a tip guard 113 are configured to cover the left and right lateral nail folds to either side of the nail. The lateral nail folds may be entirely protected by extensions 117 of the tip guard 113 to either side of the proximal edge 113*a* which slides under the distal edge of the nail. The tip guard thus provides a U-shaped slot which substantially corresponds with the U-shape formed by the lateral nails folds and quick. Alternatively, the lateral nail folds may be entirely protected by extensions (not shown) of a cuticle guard 112 to either side of the curved distal edge 112*a*. The cuticle guard would thus provide a U-shaped slot corresponding with the U-shape formed by the lateral nails folds and cuticle. As yet another alternative, both a cuticle guard and a tip guard may comprise extensions for protecting at least a portion of the lateral nail folds. In any case, one or more left and right extensions 117 are provided which extend at least the length of the lateral nail folds and preferably longer if extensions 117 include one or more elements of tip guard connector 115 (as is the case in FIGS. 2A-2B and 3A-3B). Appropriate variations and combinations of extensions 117 and tip guard connector 115 will occur to those of skill in the art in view of the teachings herein.

In yet another embodiment, the cuticle guard and tip guard may be integral and furthermore non-adjustable in a longitudinal direction relative one another. The guards preferably consist of or comprise a flexible material, such as a thin bendable plastic, which may be distorted for fitting on a finger but which resume their default shape/configuration in the absence of a distorting force. In particular, the guards may have a lightly curved profile such that when bent to a sharper angle (e.g. by bringing the longitudinal ends of the combined guards closer together), the window is enlarged. When no distorting force is present, the window is preferably sized to be at least as wide as a width of the nail and at least as long as a length between the cuticle and quick of the nail.

A mold plate 114 is attached to a cuticle guard 112 by attachment means such as joint 116 which allows rotation of the mold plate relative to the cuticle guard. Joint 116 may take a variety of forms including one or more small hinges or a ball-in-socket joint. Alternatively, a joint 116 may be a thin piece of material that allows repeated bending and twisting without breaking, for example a thin strip of non-rigid plastic. Mold plate 114 is moveable from a first position away from the nail to a second position directly over or atop the nail. In an exemplary embodiment, it is preferred that a joint 116 allow rotation of the mold plate 114 in the vertical between 0 and 180 degrees relative the cuticle guard, as shown by dashed arrows 120 and 121, and a rotation/twisting of the mold plate in the horizontal between 0 and 360 degrees, as shown by dashed arrow 122. Joint 116 may be biased to rotate with less resistance in the vertical and comparatively more resistance in the horizontal. Thus, in the absence of a deliberate force by a user intended to rotate the mold plate in the horizontal, the mold plate 114 only rotates (or pivots) in the vertical (that is, with alteration of just one degree of freedom—the angular displacement.)

The mold plate 114 has a curved inner surface 118 corresponding to the general curvature/surface topography of a nail. This has the effect of the mold plate being substantially "molded" to the top surface of the nail plate when positioned or resting directly over or atop thereof. This allows for application of a lacquer directly to at least a portion of inner surface 118 followed by transfer of the lacquer from the inner surface to the top surface of the nail, as will be discussed in greater detail below. To facilitate this transfer, the inner surface 118 of the mold plate 114 is preferably a silicone surface (e.g. comprising a thin silicone coating) or other suitable material to which lacquers such as gel or acrylic do not adhere upon curing. Mold plate 114 may also be configured to grip, cradle, and/or otherwise hold/retain fake nails such as press-on nails and pre-made nails. This can be accomplished by, for example, use of a suitable material on inner surface 118 which provides mild gripping or non-peinianent adhesion. Press-on nails and pre-made nails conventionally require direct application to the nail by a user. In accordance with the present invention, a mold plate 114 may be configured such that a press-on nail or pre-made nail may first be held by mold plate 114 and then transferred to the top surface of the nail.

In embodiments such as those shown in FIGS. 2A-2B, 3A-3B, and 4A-4B, a base 111 is adjustably attachable to a cuticle guard 112 such that the base 111 and the cuticle guard 112 may be removably fixed to a distal portion of the digit. The base is configured to provide secure attachment of the applicator 100 (and thereby the interconnected elements thereof) to the finger. Securing of the applicator 100 to a finger may be accomplished by the base alone or by the combination of the base 111 and cuticle guard 112. FIGS. 2A-2B and 3A-3B show an embodiment in which the cuticle guard 112 and base 111 together form a ring clamp which can be tightened and locked with locking tabs 200. The tabs may have inner ridges or steps on an inward facing surface (not shown). One or more projections or teeth (not shown) on the base 111 and facing a locking tab 200 may selectively lock into any one of the plurality of steps. The steps and teeth may operate in substantially the same manner of operation as reversible zip ties. The shape and material of the base are preferably selected to optimize gripping characteristics with the human skin. According the embodiment shown in FIGS. 2A-2B and 3A-3B, base 111 is (semi-)tubular in shape with a curved inner surface having substantially the same shape, size, and contour of the underside of a fingertip. This maximizes the contact surface area without substantial excess material and weight. A base 111 may include one or more textiles, rubbers, or plastics which provide comfort and/or friction between the applicator 100 and the underside of the finger. In an exemplary embodiment, the base 111 is of a length not exceeding that of the distal phalanx. This allows a user to freely bend his or her digit at, for example, the distal interphalangeal joint while the applicator is fitted and secured on the finger.

In an alternative embodiment, base 111 may comprise one or more elastic straps preferably of a length less than a circumference of a distal portion of a finger. When affixed to the finger, the base would advantageously maintain tension to hold the other components, in particular the cuticle guard, in a fixed and stable position relative the nail/finger. A base 111 may take a variety of forms in different embodiments, although all forms must provide secure attachment of the applicator to the digit. Suitable variations according to these teachings will be apparent to those of skill in the art.

Figure 4A:
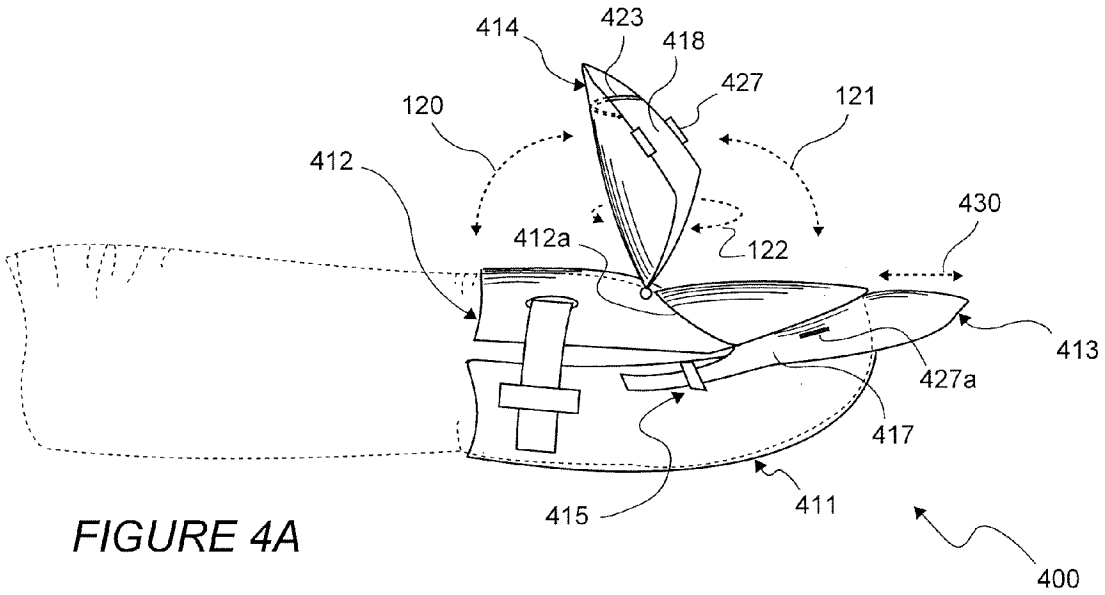
FIGS. 4A and 4B is another embodiment of a nail styling device for applying a lacquer to a nail of a digit.
Figure 4B:
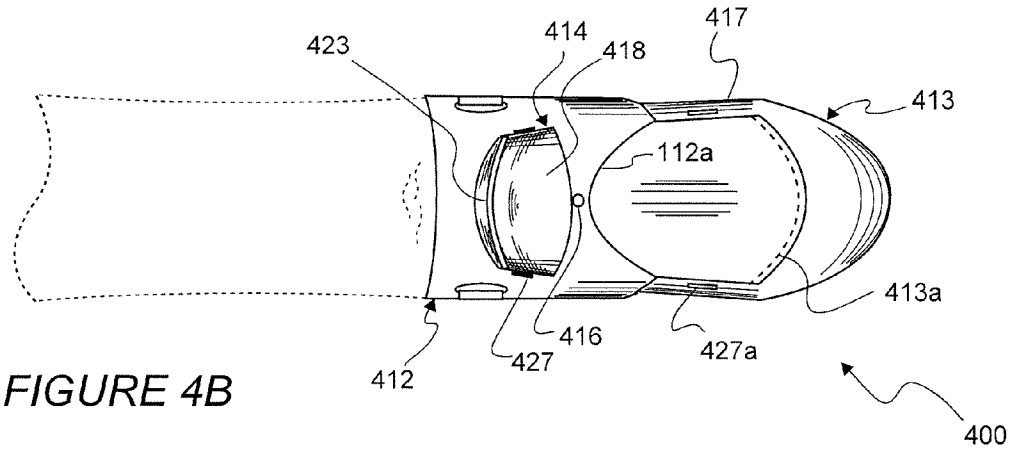

FIGS. 4A and 4B shows an applicator 400 similar to applicator 100 but having a tip guard 413 directly attachable to a base 411. Tip guard 413 is slideable relative to the base, as generally shown by arrow 430. Cuticle guard 412 comprises extensions 417 to either side of the curved distal edge 412*a* to cover or shield the lateral nail folds from exposure to lacquer.

An applicator 100, as in FIGS. 2A-2B and 3A-3B, or 400, as in FIGS. 4A-4B, may also comprise one or more locks 427 for securing mold plate 114/414 to tip guard 113/413 after the lacquer is in contact with the nail. That is, a lock 427 is configured to reversibly fix the mold plate 414 to the tip guard 413 when the mold plate is in a closed configuration. Locks 427 may take different forms, for example the small catch tabs shown in FIG. 4 which engage with slots 427*a*, and advantageously prevent accidental lifting of the mold plate away from the surface of the nail prior to curing the lacquer.

A spacer 423 may be affixed to an inner surface 418 of a mold plate 414, such as is shown in FIG. 4. Spacer 423 generally comprises a small raised edge or wall which preferably spans the width of the inner surface 418 of a mold plate 414. A spacer 423 provides a barrier separating a proximal portion of inner surface 418 which corresponds to a proximal portion of a nail to which it is desirable to apply a lacquer and a distal portion of inner surface 418 which corresponds to a distal portion of the nail to which it is undesirable to apply a lacquer. A spacer 423 may take various contours according to a desired style of the user. A space may be substantially linear, for example, or curved, respectively providing a square shape or an oval shape at the tip of the nail. Different spacer contours provide correspondingly different contours to the distal edge of the lacquer on the surface of the nail.

Generally, a spacer 423 is adjustable (e.g. slideable) in a longitudinal direction relative the mold plate 414 to vary the sizes of the proximal portion of the inner surface 418 (and thereby a lacquered proximal portion of the nail) as compared to a distal portion of the inner surface 418 (and thereby an unlacquered distal portion of the nail). In effect, a spacer defines the length of the artificial nail. In addition, a spacer provides a particular spacing between the inner surface 418 and the top of the nail when the mold plate 414 is in a position directly over/atop the nail. Lacquer will fill this predetermined spacing during use of the applicator at the step of transferring lacquer from inner surface 418 to the nail. In effect, the spacer reduces or prevents uneven thickness of lacquer on the nail by preventing direct contact between inner surface 418 of mold plate 414 and the nail. Providing multiple interchangeable spacers with different heights or thicknesses allows for different spacing measures between inner surface 418 of the mold plate and the top nail surface, thereby allowing control and repeatability as to different thicknesses of the lacquer being applied to the nail. In practice, a lacquer may be applied to the inner surface 418 and, upon closure of mold plate 414 such that the lacquer is brought in contact with the nail, lacquer can be forced out to an even distribution between the cuticle guard, extensions protecting the lateral nail folds, and the spacer. These edges collectively define an enclosed space which is the proximal portion of the nail being lacquered. The thickness of lacquer on top of the nail itself is determined by the inner surface 418 to nail surface spacing, as provided by the pre-selected and affixed spacer 423.

It should be noted that features illustrated in FIGS. 4A-4B with respect to applicator 400 may likewise be included in embodiments such as that shown in FIGS. 2A-2B and 3A-3B. For example, applicator 100 may be provided with one or more spacers 423, locks 427, and slots 427*a*.

Figure 5:
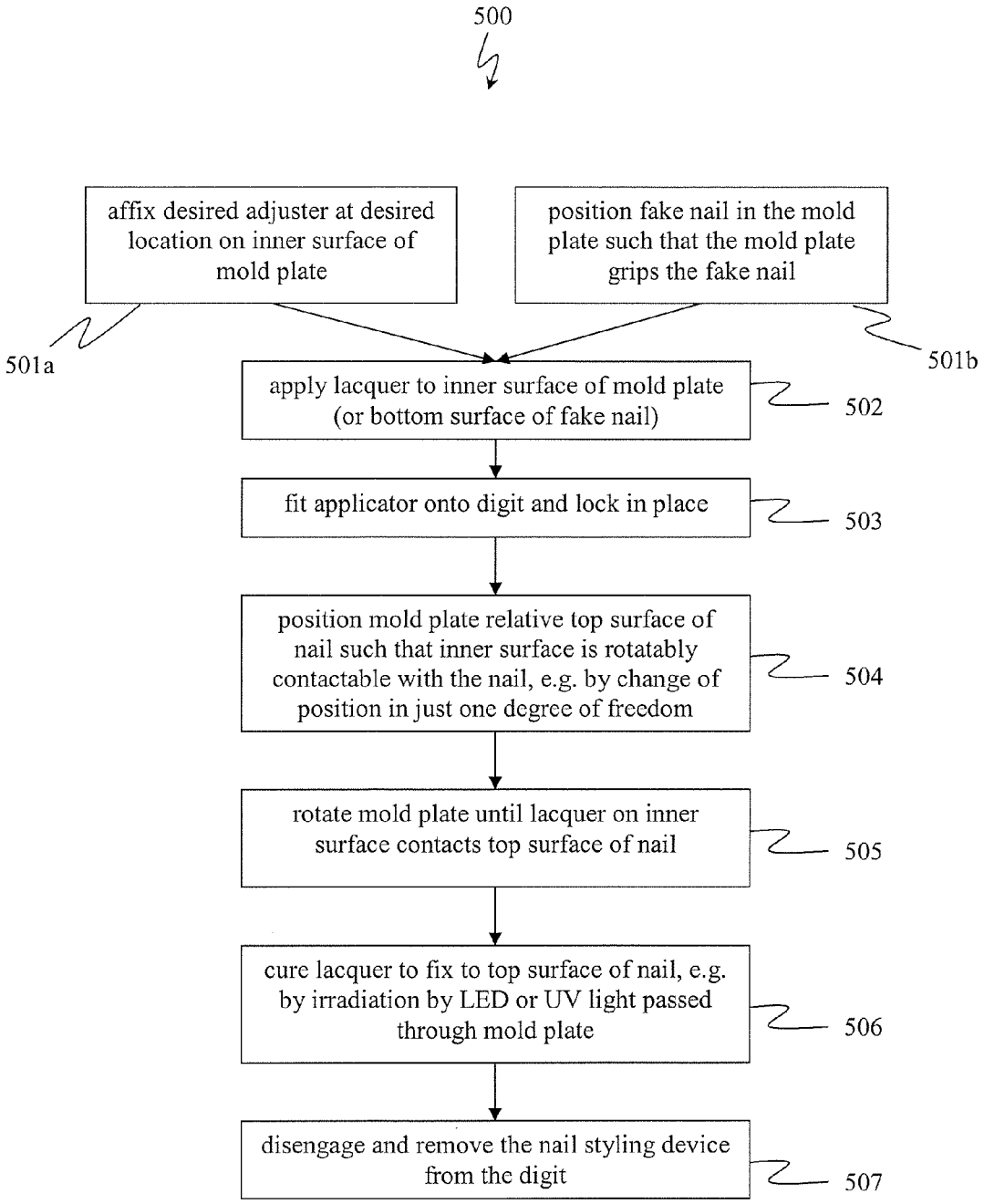
FIG. 5 is a method for applying a lacquer to a nail of a digit.

FIG. 5 shows a method 500 which may be implemented with an applicator according to the invention. Generally, method 500 requires applying a lacquer to an inner surface of a mold plate of an applicator (step 502), fitting the applicator onto a distal portion of a digit and locking it in place (step 503), and transferring the lacquer to the nail of the digit by contacting the lacquer to the nail plate and curing the lacquer (steps 505/506).

A lacquer, in particular a gel or acrylic, may be applied to an inner surface of a mold plate by any suitable means (step 502). Generally, this may be accomplished with a brush such as that which is traditionally used when applying gels or acrylics directly to the nail. If it is desired that the nail only have a lacquer applied to proximal portion of the nail, e.g. an area from the cuticle up to an optionally curved line preceding the distal end of the nail plate, a spacer should be affixed at the appropriate position along the inner surface of the mold plate (step 501*a*) prior to applying the lacquer to the inner surface. The lacquer may then be applied up to the spacer.

The applicator is then fitted on to a distal portion of the digit and locked in place (step 503). Applying the lacquer to the mold plate prior to fitting the applicator on a finger advantageously allows a user to always perform step 502 of applying the lacquer with his or her dominant hand. However, step 503 of fitting and locking the applicator onto a digit may be performed prior to step 502 of applying the lacquer to the mold plate. Fitting of the applicator on the digit includes aligning the distal edge 112*a* of the cuticle guard with the edge of the cuticle and sliding the proximal edge 113*a* of the tip guard under the distal end of the nail. As illustrated in FIGS. 2A-2B, 3A-3B, and 4A-4B, the applicator 100 or 400 may be locked in place by pressing together the cuticle guard and base such that locking tabs 200 engage and provide for a friction grip of the finger by the cuticle guard and base.

The mold plate should be positioned relative the top surface of the nail such that the inner surface, in the absence of a spacer, is rotatably contactable with the nail (step 504). Generally, this will amount to an angular displacement between the inner surface of the mold plate and the top surface of the nail. The mold plate may then be rotated until the lacquer on the inner surface contacts the top surface of nail (step 505). According to this process, the lacquer is applied to the nail by the mold plate with a change in just one degree of freedom of the mold plate (e.g. by just an angular displacement of the mold plate). This advantageously reduces the likelihood of user error which is present when free-handedly applying a lacquer directly to a nail with a brush.

In the case locking means are provided between the mold plate and the tip guard, this locking means should be engaged to prevent the accidental lifting of the mold plate prior to setting the lacquer.

The mold plate is in a "closed position" when generally mated to a top portion of the nail such that at most only a small gap exists between the inner surface of the mold plate and the top surface of the nail, the small gap being filled with the lacquer. As such, the lacquer is in simultaneous contact with the inner surface of the mold plate and the top surface of the nail.

With the mold plate in a closed position, the lacquer may then be cured to properly fix the lacquer to the surface of the nail (step 506). Generally, curing is accomplished by irradiation of the lacquer with light from a suitable LED or UV light source as is standard practice in the art for curing gels and acrylics. For embodiments having a translucent mold plate, irradiation may be accomplished by passing the LED or UV light through the top of the mold plate. Upon curing, the lacquer will be preferentially adhered to the surface of the nail as compared to the inner surface of the mold plate (which, as discussed above, may be coated with silicone or some other treatment or material which prevents adherence of cured lacquer). At such point, the applicator may be disengaged from the digit and removed (step 507). The application of lacquer to the nail may be complete or additional styling options may follow.

For applying a fake nail such as a press-on nail, pre-made nail, or similar fake nails, method 500 may be used with small variations to the steps employed for applying an acrylic or gel. Prior to applying a lacquer (step 502), the fake nail should be positioned in the mold plate such that the mold plate grips the fake nail (e.g. by temporary adhesion) (step 501*b*). If the fake nail requires a glue or other adhesive to attach to the nail, an appropriate adhesive lacquer should be applied to the bottom surface of the fake nail (which now covers at least a portion of the inner surface of the mold plate) at step 502. If the fake nail already includes an adhesive lacquer, step 502 may be omitted. Subsequent steps such as shown in FIG. 5 and already discussed above may then be followed to complete application of the fake nail to the top surface of the real/natural nail using the applicator. The applicator may optionally be used to additionally apply a top lacquer to the fake nail as needed or desired.

Those of skill in the art will recognize that other steps which are known for applying a fake nail or lacquer, in particular a gel or acrylic, to a nail may be used together with the teachings herein. As an example, method 500 may include the optional step of prepping the nail, such as by cleaning the nail to remove any previous polish, acrylic, or gel and removing any liquids such as skin oils. The method may further include lightly buffing/abrading the surface by filing to facilitate adherence of the lacquer to the nail. Method 500 is nonlimiting and may include additional or fewer steps than what are shown in FIG. 5.

Provided that the distal phalanx of each digit of a hand or a foot can vary in size (e.g. length and girth) and nail plate dimensions may vary between digits as well as persons, it is advantageous to have a kit of applicators with a range of sizes. By way of example, a kit may comprise three applicators—one each sized and otherwise configured for use with a thumb, a pinky, or any of the three middle fingers (these being similar in shape and size to one another). Similarly, a kit may have five applicators, one sized according to each of the five digits. A kit may furthermore be specifically for fingernails or specifically for toenails, with applicators sized accordingly.

In some embodiments, a kit may comprise more than five, ten, twenty, or fifty applicators with small variations in size between each. This advantageously allows a user to select a size which very closely approximates the exact dimensions of his or her digit and nail plate.

In an embodiment, two or more applicators may be linked or combined such that a single nail styling device allows for concurrent application of lacquer to more than one nail. In such case, one base may be provided for a plurality of digits.

An applicator may be entirely or predominantly made of plastics or other materials which are optionally disposable or reusable. Silicone or other material or treatment which does not adhere to cured lacquer may furthermore line other surfaces or edges besides an inner surface of the mold plate. For example, silicone may line the component edges surrounding the nail to provide a close seal which prevents lacquer reaching any skin tissue.

While preferred embodiments of the present invention have been disclosed herein, one skilled in the art will recognize that various changes and modifications may be made without departing from the scope of the invention as defined by the following claims.

I claim:

1. A nail styling device for applying a lacquer to a nail of a digit, comprising:

a cuticle guard configured to cover or shield a top surface of a distal portion of said digit and having a curved distal edge sized to fit a cuticle of said digit;

a tip guard moveable in a longitudinal direction relative said cuticle guard, said tip guard having a proximal edge slideable under a distal end of said nail, wherein one or both of said cuticle guard and said tip guard are configured to cover or shield a lateral nail fold to either side of said nail;

a mold plate having a curved inner surface corresponding to a curvature of said nail and able to receive a coating of said lacquer, said mold plate being attached to said cuticle guard by a joint and moveable from a first position away from said nail to a second position directly over said nail such that said coating of said lacquer contacts said nail; and a base adjustably attachable to said cuticle guard such that said base and said cuticle guard are removably fixable to said distal portion of said digit.

2. The nail styling device of claim 1, wherein a spacer attachable to said inner surface of said mold plate which provides a predetermined spacing between said inner surface and said nail when said mold plate is in said second position.

3. The nail styling device of claim 2, wherein said spacer is adjustable in a longitudinal direction relative said mold plate.

4. The nail styling device of claim 1, wherein said inner surface of said mold plate comprises a material to which cured lacquer does not adhere.

5. The nail styling device of claim 4, wherein said material is a silicone coating on said inner surface.

6. The nail styling device of claim 1, wherein said joint allows a rotation of said mold plate in the vertical of up to 180 degrees relative said cuticle guard and a rotation of said mold plate in the horizontal of up to 360 degrees.

7. The nail styling device of claim 1, wherein said mold plate is translucent and allows for transmission of light of a light-emitting-diode or ultraviolet light source.

8. The nail styling device of claim 1, wherein said tip guard is attachable to said cuticle guard.

9. The nail styling device of claim 1, wherein said tip guard is attachable to said base.

10. The nail styling device of claim 1, wherein said mold plate is removably attached to said cuticle guard by said joint.

11. The nail styling device of claim 1, further comprising a lock configured to reversibly fix said mold plate to said tip guard when said mold plate is in a closed configuration.

12. A nail styling device for applying at least one nail styling product to a nail of a digit, comprising:

a cuticle guard configured to cover or shield a top surface of a distal portion of said digit and having a curved distal edge sized to fit a cuticle of said digit;

a tip guard moveable in a longitudinal direction relative said cuticle guard, said tip guard having a proximal edge slideable under a distal end of said nail, wherein one or both of said cuticle guard and said tip guard are configured to cover or shield a lateral nail fold to either side of said nail;

a translucent mold plate having a curved inner surface corresponding to a curvature of said nail, wherein said at least one nail styling product can be applied to said curved inner surface, said translucent mold plate being attached to said cuticle guard by a joint and moveable from a first position away from said nail to a second position directly over said nail, wherein said joint allows a rotation of said translucent mold plate in the vertical of up to 180 degrees relative said cuticle guard and a rotation of said translucent mold plate in the horizontal of up to 360 degrees; and a spacer attachable to said inner surface of said translucent mold plate which provides a predetermined spacing between said inner surface and said nail when said translucent mold plate is in said second position and said at least one nail styling product is brought into contact with said nail, wherein said spacer is adjustable in a longitudinal direction relative said translucent mold plate; and a base adjustably attachable to said cuticle guard such that said base and said cuticle guard are removably fixable to said distal portion of said digit.

13. The nail styling device of claim 12, wherein said at least one nail styling product is selected from the group consisting of a base coat, a gel lacquer, an acrylic lacquer, an adhesive lacquer, a fake nail, and a nail extension.

* * * * *